US005241159A

United States Patent [19]

Chatteriee et al.

[11] Patent Number: 5,241,159

[45] Date of Patent: Aug. 31, 1993

[54] MULTI-ZONE HEATING FOR A FUSER ROLLER

[75] Inventors: Dilip K. Chatteriee; Gustavo R. Paz-Puzalt, both of Rochester, N.Y.

[73] Assignee: Eastman Kodak Company, Rochester, N.Y.

[21] Appl. No.: 849,543

[22] Filed: Mar. 11, 1992

[51] Int. Cl.[5] ..... H05B 3/02; G03G 15/20

[52] U.S. Cl. ..... 219/470; 219/216; 355/290

[58] Field of Search ..... 219/216, 469–471; 355/290

[56] References Cited

U.S. PATENT DOCUMENTS

| | | | |
|---|---|---|---|
| 3,105,133 | 9/1963 | Norton | 219/469 |
| 3,595,539 | 7/1971 | Kimura et al. | 263/6 E |
| 3,624,353 | 11/1971 | Bjorklund | 219/470 |
| 3,861,863 | 1/1975 | Kudsi | 432/60 |
| 4,158,128 | 6/1979 | Evdokimov | 219/469 |
| 4,266,115 | 5/1981 | Dannatt | 219/216 |
| 4,329,566 | 5/1981 | Hooper | 219/216 |
| 4,365,139 | 12/1982 | Dannatt | 219/216 |
| 4,377,336 | 3/1983 | Parks et al. | 355/3 FU |
| 4,571,056 | 2/1986 | Tani et al. | 355/3 FU |
| 4,585,325 | 4/1986 | Euler | 219/216 |
| 4,585,325 | 4/1986 | Euler | 355/3 FU |
| 4,595,274 | 6/1986 | Sakurai | 355/3 FU |
| 4,883,941 | 11/1989 | Martin | 219/216 |
| 4,967,237 | 9/1988 | Sasaki et al. | 355/290 |
| 4,990,751 | 2/1991 | Nous | 219/469 |
| 5,151,576 | 9/1992 | Zaoralek | 219/469 |

*Primary Examiner*—Bruce A. Reynolds
*Assistant Examiner*—Michael D. Switzer
*Attorney, Agent, or Firm*—J. Gary Mohr

[57] ABSTRACT

A fusing roller is provided that has multiple pattern groupings of heat elements of different heating capacities located adjacent heat sensors within the fusing roller. The individual heat elements of the same grouping are of the same heating capacity, while individual heat elements not of the same grouping are of different heating capacity. The difference in heating capacity is due to the differences in coil length of the various heat elements. By controlling the flow of current to any one or more groupings of heat elements, a specific fusing temperature range can be applied to designated areas about the peripheral surface of the fuser roller, thereby maintaining these areas of the fusing roller at a desired fusing temperature.

5 Claims, 4 Drawing Sheets

MULTI-ZONE HEATING FOR A FUSER ROLLER

BACKGROUND OF THE INVENTION

1. Field of the Invention

This invention relates to a heated fuser roller as is commonly used in copying machines, and more particularly to a heated fuser roller having multiple groupings of internal heat elements.

2. Description of the Prior Art

A typical approach to fusing a toner image is by a hot roller-pressure fuser apparatus. In this type of apparatus, the paper, with the toner image thereon, is passed between a pair of rollers, at least one of which is heated. Generally, the heated roller formed of a hollow cylinder having a radiant heater, such as an infrared lamp, centrally located within the cylinder, to heat the roller. During operation of the fusing apparatus, the paper to which the toner image is electrostatically adhered is passed through a nip, formed between the rollers, with the toner image contacting the fuser roller to effect heating of the toner image within the nip. A thermostat, monitoring the process, intermittently interrupts or restores the current flow, to the infrared lamp, in an attempt to maintain the surface roller temperature at a predetermined optimum value.

Many of the problems that occur with the use of the hot roller-pressure fusing apparatus relate to the means employed for heating the fuser roller and its control. For example, in many of the known hot roller fusers it is extremely difficult to maintain a desired temperature, at particular sections of the roller, along the nip where the actual fusing of the toner occurs, and where temperature control is critical. Temperature control is difficult because (1) paper of different sizes requires enlarging or decreasing the heating zone, of the roller, to conform to the size of the paper; (2) neither a single central element nor multiple heating elements, such as disclosed in U.S. Pat. Nos. 4,266,115, 4,377,366 and 4,585,325, is able to adjust to all the varying demands of non-uniform thermal output during the fusing process; and (3) adjustments must be made for different machine modes, i.e., standby, off, continuous operation.

SUMMARY OF THE INVENTION

It is therefore an object of the present invention to overcome many of the disadvantages of the hot roller fusers described in the prior art by providing a fusing roller having a cylindrical member of thermally conducting material with a peripheral surface at which a receiver is fused. Positioned within the cylindrical member are at least three groupings of heat elements, such that individual heat elements of the same group are of the same heating capacity and individual heat elements not of the same group are of different heating capacity and with each group having a different heating capacity for providing an even heat flow distribution to specific areas about the peripheral surface of the cylindrical member. Also positioned within the cylindrical member are heat sensing means adjacent to the heat elements for sensing the heat generated by the heating elements.

BRIEF DESCRIPTION OF THE INVENTION

DETAILED DESCRIPTION OF THE PREFERRED EMBODIMENT

Figure 1:
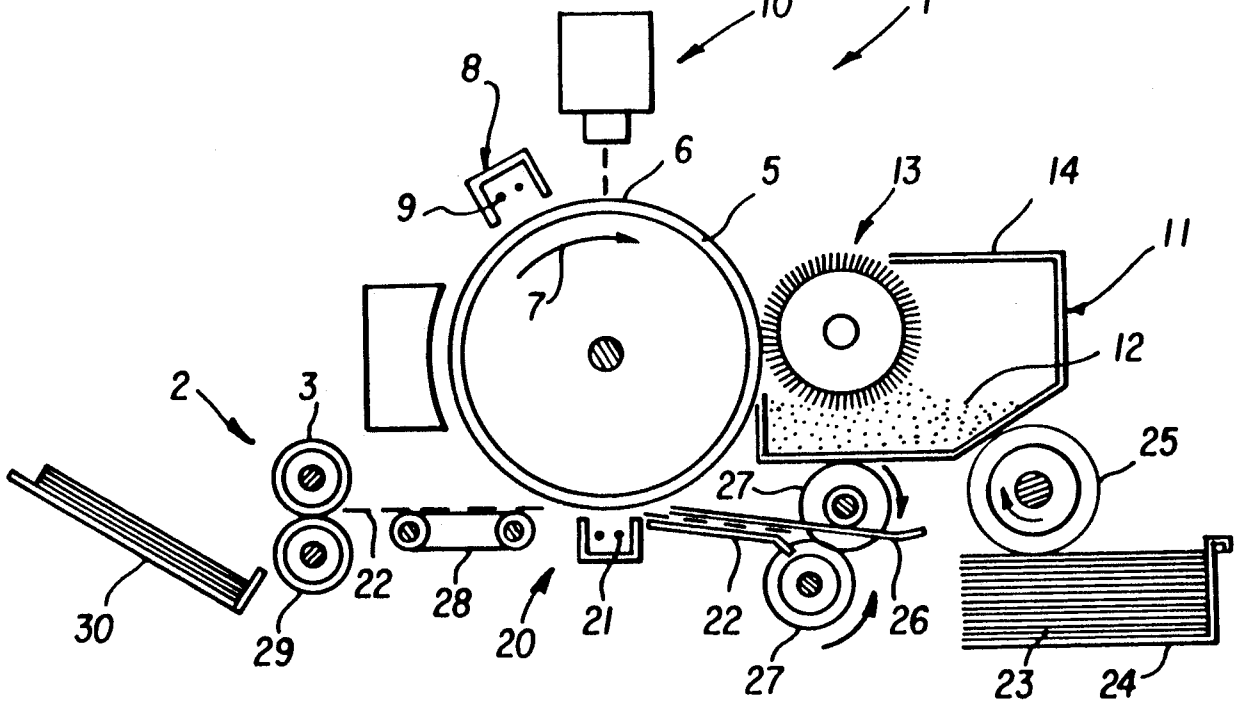
FIG. 1 (prior art)
FIG. 1 is a schematic sectional view of a prior art copier.

While the present invention is susceptible to embodiments of many different forms, there is shown in the drawings and hereinafter described, in detail, a preferred embodiment of the invention. It should be understood, however, that the present disclosure is to be considered as an exemplification of the principles of the invention and is not intended to limit the invention to the embodiments illustrated and/or described.

For ease of description, all mechanisms will be described in their normal operational positions, and terms such as upper, lower, horizontal, etc. . . . , will be used with reference to normal operating positions. It will be understood, however, that any mechanism may be manufactured, stored, transported and sold in an orientation other than the normal operational positions described.

In describing the preferred embodiment of the present invention, reference is made to the drawings, wherein like numerals indicate like parts and structural features in the various views, diagrams and drawings.

Figure 2:
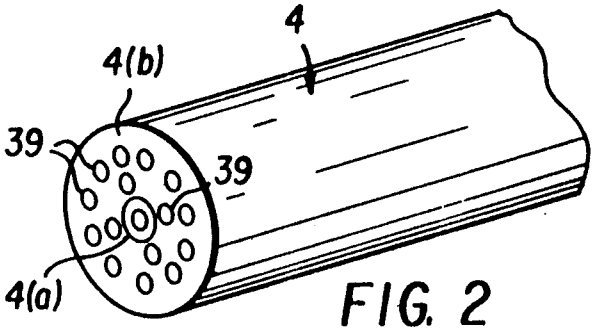
FIG. 2 is a perspective view of the fuser roller in accordance with the present invention.

The environment of a multi-zoned heat fusing roller 4, see FIG. 2, which is the subject matter of the present invention, is a reproduction apparatus 1, see FIG. 1, such as an electrophotographic copying machine. Briefly, such an electrophotographic copying machine 1 has various stations which include a rotating drum 5 or a belt, said belt not being shown, but known in the art. A photoconductive surface 6, such as a selenium alloy, is secured around the outer surface of drum 5. As drum 5 rotates, in the direction of arrow 7, photoconductive surface 6, of drum 5, moves adjacent to the various processing stations disposed around the periphery of drum 5.

During the initial rotation of drum 5, a portion of photoconductive surface 6 moves adjacent to a charging apparatus 8 which includes a corona generating device 9 that imparts a uniform electrostatic charge to photoconductor surface 6. After said electrostatic charge is imparted, an image, of a document to be copied, is transmitted to photoconductor surface 6 by exposure at imaging station 10.

As drum 5 continues to rotate, the image on photoconductive surface 6 is carried past a developer station 11, where toner particles 12 are applied to the image. This is typically accomplished by a rotating magnetic roller 13 that picks up toner particles 12, from a hopper 14, and brings them into contact with the image on photoconductive surface 6 to electrostatically develop the image.

As drum 5 further rotates, the toner image moves adjacent a transfer station 20, which includes a corona transfer charging apparatus 21. At the same time the toner image arrives at transfer station 20, a receiver 22, such as a paper sheet of varying size or an envelope, from a supply of sheets or envelopes 23, stored in removable universal tray 24, also arrives at transfer station 20. Instead of using a single universal removable tray, such as tray 24, adjustable to hold many sizes of image receivers, copier 1 may have multiple trays with each tray containing a different size of image receiver. Receiver 22 is fed to transfer station 20 by a feed roller 25 which urges receiver 22 through a guide 26 and into the nip of queuing rollers 27. To assure that the toner image and receiver 22 arrive at transfer station 20 at the same time, at a predetermined time in the course of a copy cycle, the queuing rollers 27 are actuated to feed receiver 22 along guide 26 and into contact with the developed image carried on photoconductive surface 6.

By virtue of an electrical charge that is generated by transfer corona 21, within transfer station 20, toner particles 12 are attracted from photoconductive surface 6, toward receiver 22, to which they loosely adhere. After transferring toner particles 12 to receiver 22, receiver 22 is stripped away from drum 5, by a suitable apparatus, and advanced, by belt conveyor 28, to a fusing station 2.

As receiver 22 passes through fusing station 2, which includes a fusing roller 3, toner particles 12, now residing on copy paper 22, are heated and fused to copy paper 22, by the interaction of fuser roller 3 and back up roller 29, thereby forming a permanent copy of the original document on receiver 22. After the toner image is permanently affixed to receiver 22, receiver 22 is separated from fuser station 2 and advanced to a catch tray 30 for subsequent removal, from the copier, by an operator.

Figure 3:
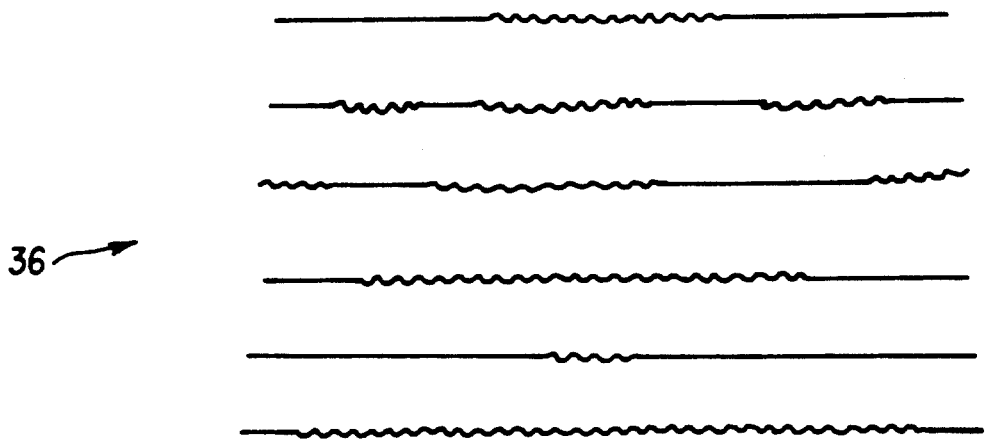
FIG. 3 is a schematic view of the various heating elements in accordance with the present invention.

In the present invention, fusing roller 3, of the above prior art apparatus, is replaced by multi-zoned heat fusing roller 4, see FIG. 2. Fusing roller 4 is manufactured with a core 4(*a*) of a ceramic material, such as refractory oxides, like $Al_2O_3$, Mulite, $M_gO$ or their mixes and nitrides. Surrounding core 4(*a*) is a thermally conductive cylindrical member 4(*b*), constructed of a material such as graphite, silicon carbide, aluminum, copper, silver, platinum or an equivalent thermally conductive material. Within this thermally conductive member 4(*b*), surrounding core 4(*a*), are multiple bores 39, to accommodate any one of a number of heat elements 36; see FIG. 3. When heat elements 36 are inserted into bores 39, they are inserted in pattern groupings such as shown in FIGS. 8, 9, 10 and 11. While FIGS. 8, 9, 10 and 11 show each pattern grouping in individual rollers, this is only for clarity of discussion, it being understood that all pattern grouping, such as shown in FIGS. 8, 9, 10 and 11, as well as others that may be used, but not shown, are located in a single fusing roller 4. When heat elements 36 are inserted into bores 39, each individual pattern grouping is comprised of heat elements 36 of the same heating capacity. For example, all heat elements 36*a* have the same heat capacity; all heat elements 36*b* have the same heat capacity; all heat elements 36*c* have the same heat capacity and all heat elements 36*d* have the same heat capacity, but in relation to each other the individual heating capacities of heat elements 36*a*, 36*b*, 36*c* and 36*d*, as shown in FIGS. 8, 9, 10 and 11, are different. The group insertion pattern of heat elements 36 is such that the concentrated heat flow from each individual grouping pattern, which consist of at least two heat elements 36 evenly spaced about the axis of fusing roller 4, is able to quickly produce and maintain a specified fusing temperature range at a designated area or areas about the periphery of the surface of fusing roller 4. Since fusing roller 4 contains a multitude of grouping patterns, such as those shown in FIGS. 8, 9, 10, and 11, as well as grouping patterns not shown, by using the concentrated heat flow of an individual grouping pattern or combination of grouping patterns, a multitude of different temperatures may be created and maintained, at designated areas about the peripheral surface of fusing roller 4 to optimize the fusing process. It is therefore just a matter of determining what individual grouping pattern or combination of grouping patterns are required to provide and maintain the predetermined optimum fusing temperature or temperature range, at the surface of fusing roller 4, for receiver 22 being fused. In addition to using individual grouping patterns or combinations of grouping patterns, with all the grouping patterns being supplied the same electrical current, to obtain the predetermined optimum surface fusing temperature, the surface fusing temperature may be adjusted by varying the electrical current supplied to the individual pattern groupings as later discussed. This ability to control the temperature, at the surface of fusing roller 4, by pattern grouping and adjustment of electrical current to the individual pattern groupings is a significant step in surface temperature fusing control over the prior art. The prior art, at most, used only two different heat elements to control fusing temperature, thereby limiting the number of areas along the periphery of the fusing roller that could be controlled, the amount of control that could be applied to those areas and the response time for varying the fusing temperature.

The preferred materials for heat elements 36, notwithstanding their heating capacity, are materials such as nichrome, kanthal, super kanthal, inconel (Ni-based), ruthenium oxide and nickel oxide. The difference in heating capacity of heat elements 36 is obtained by varying the coil lengths or coil positions of heat elements 36; see FIG. 3. In addition, the heat output, as previously stated, of each individual pattern grouping of heat elements 36 may be changed by varying the amount of current supplied to that particular pattern grouping of heat elements 36.

Figure 5:
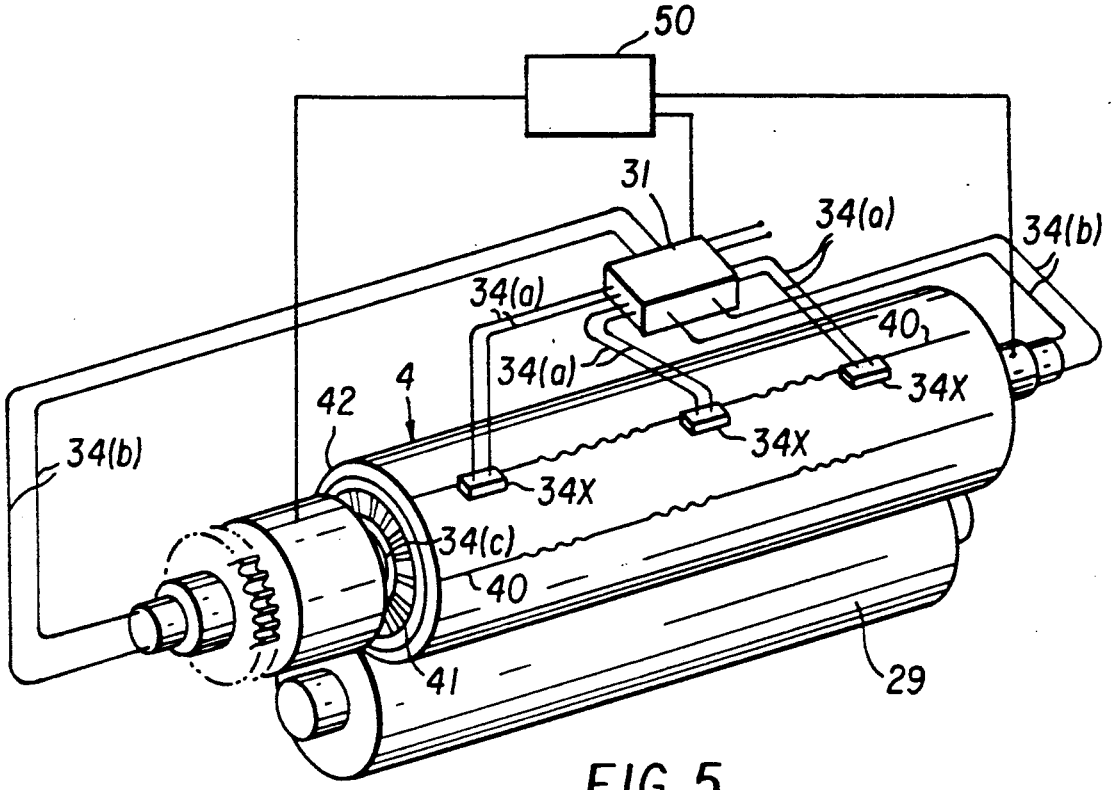
FIG. 5 is a perspective view of the fuser roller and logic circuit in accordance with the present invention.
Figure 6:
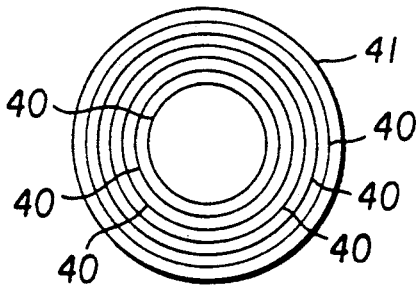
FIG. 6 (prior art)
FIG. 6 is a schematic side view of a prior art multi-ring slip ring.

To supply current to a pattern grouping or groupings, of heat elements 36, all heat elements 36, within a particular pattern grouping, have their leads 40, see FIG. 6, connected to a current source 50, through a common electrical connecting means 41, such as a ring of a multi-ring slip ring or its equivalent located at both outer end portions 42, see FIG. 5, of fusing roller 4.

Figure 7:
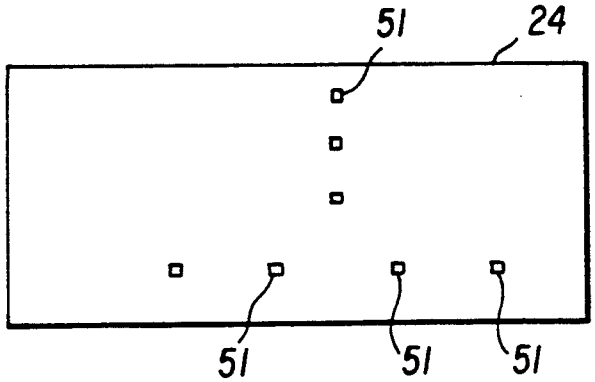
FIG. 7 (prior art)
FIG. 7 is a schematic top view of a prior art paper or envelope tray with limit switches.
Figure 8:
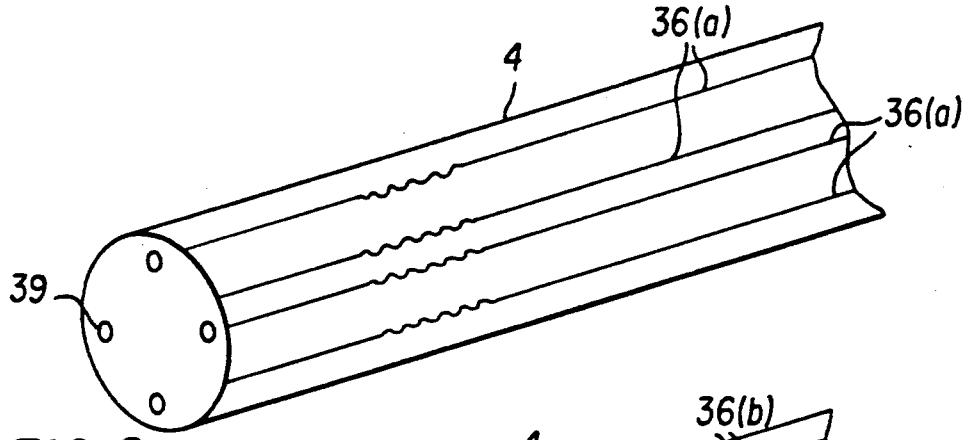
FIG. 8 is a perspective view of an example of one grouping pattern for the heat elements of the fusing roller.
Figure 9:
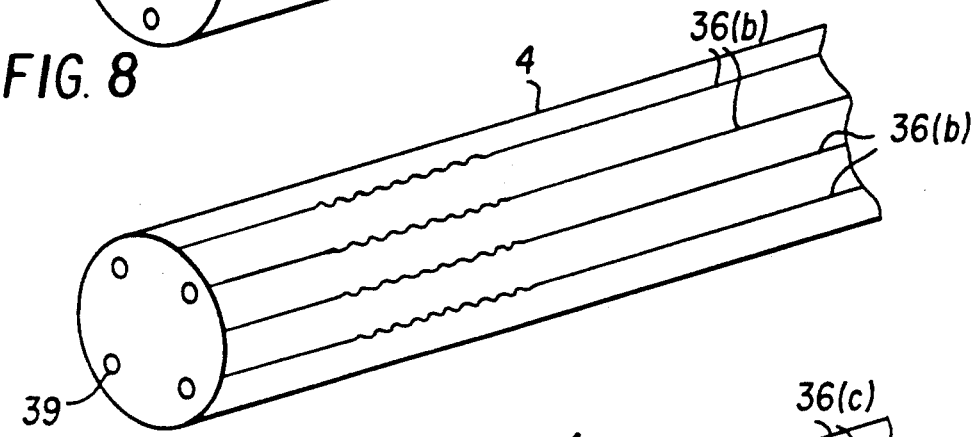
FIG. 9 is a perspective view of another example of a grouping pattern for the heat elements of the fusing roller.
Figure 10:
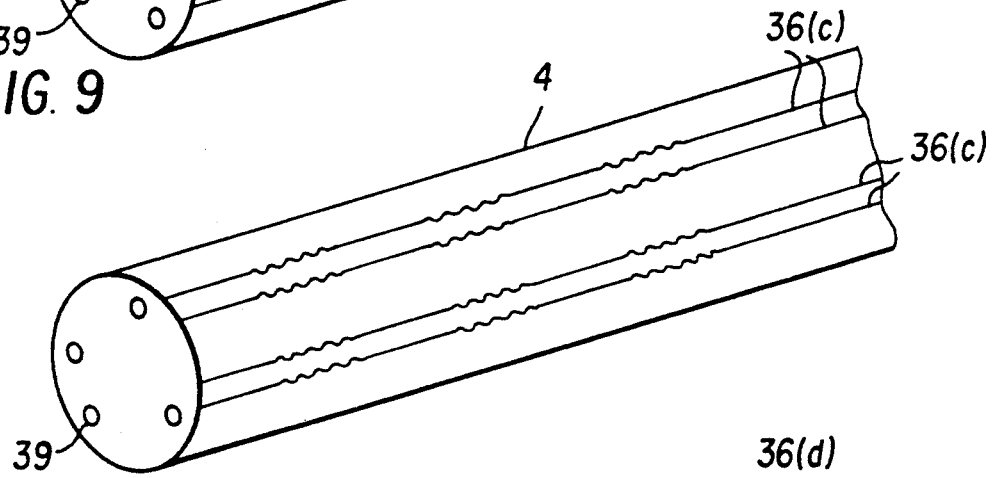
FIG. 10 is a perspective view of yet another example of a grouping pattern for the heat elements of the fusing roller.
Figure 11:
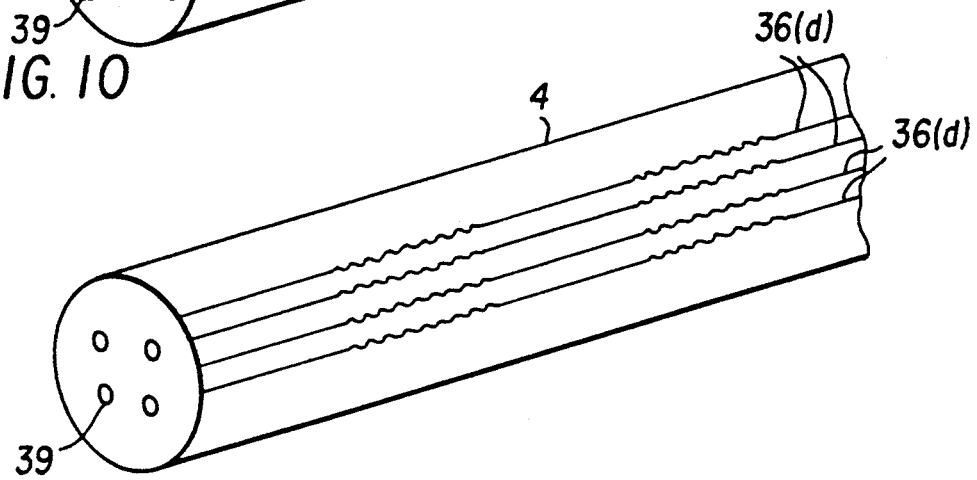
FIG. 11 is a perspective view of still another example of a grouping pattern for the heat elements of the fusing roller.

To determine the amount of initial heat to be applied to a particular surface area or areas of fusing roller 4, for a particular receiver 22, sensing means 51, such as limit switches, which are known in the art, see FIG. 7, are positioned in tray 24. Limit switches 51 sense the size of receiver 22, in tray 24, and convey that size information to a logic and control unit 31, of a type that is well known in the art; see FIG. 5. Upon logic and control unit 31 receiving an input from limit switches 51, identifying receiver 22 contained in tray 24, logic and control unit 31 outputs a signal to current source 50, indicating what pattern grouping or combination of pattern groupings, of heat elements 36, are to be supplied with electrical current and the amount of electrical current to be supplied to each individual pattern grouping, so as to produce a heat flow, to the surface of fusing roller 4, that will provide the predetermined optimum surface fusing temperature to a designated area or areas of fusing roller 4 to fuse receiver 22.

Figure 4:
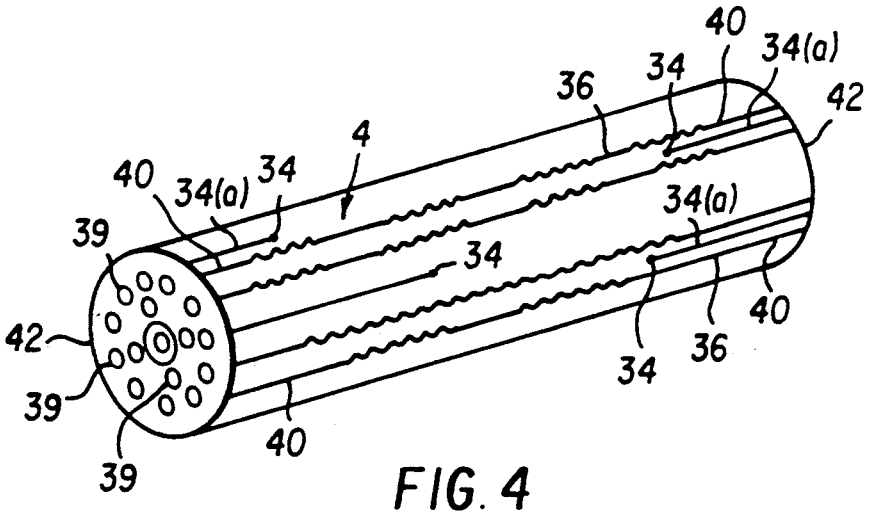
FIG. 4 is a perspective view of the fusing roller of the present invention, showing heat elements of varying capacity within the fuser roller.

To monitor and adjust the heat flow generated by heat elements 36, after the initial sensing by limit switches 51, and thereby assure that a proper fusing temperature was provided and is maintained, in a designated area or areas, along the surface of fusing roller 4, heat sensors 34, such as thermistors, having a plus or minus 1% deviation, are positioned within fusing roller 4 adjacent heat elements 36; see FIG. 4. The output of each heat sensor 34, produces a signal, corresponding to the heat sensor, which signal is then transmitted, to logic and control unit 31, through leads 34(*a*) and a ring or rings of multi-ring slip ring 34(*c*), see FIG. 5, located at opposite ends of fusing roller 4. Logic and control unit 31 then compares the signal of each interior heat sensor 34 to a known signal range that represents the predetermined optimum surface temperature of fusing roller 4 to fuse receiver 22 that had been sensed in tray 24. If said comparison results in a value that is more or less than the known signal range, logic and control unit 31 signals current source 50 to adjust the flow of electrical current to one or more groupings of heat elements 36 until the signal from heat sensors 34 is within the known signal range, signifying that the predetermined optimum fusing temperature has been reached. When the signal from heat sensors 34 is within the known signal range, logic and control unit 31 again adjusts the current flow, from current source 50, to the pattern grouping or groupings, of heat elements 36, to maintain the proper fusing temperature at the surface of fusing roller 4.

While it is not necessary to monitor the surface temperature of fusing roller 4, through sensors external of fusing roller 4, it may be done, if so desired, through the use of surface heat sensors 34*x*, which may be of the same type as internal heat sensors 34, and which may be positioned as disclosed in U.S. Pat. No. 4,585,325. If, however, for a particular application, one wishes to monitor more or less of the surface of fusing roller 4, the number and location of surface heat sensors 34*x* may be adjusted accordingly. Once it has been determined to monitor the surface temperature of fusing roller 4 by surface heat sensors 34*x*, that monitoring could be used for two purposes. The first, to use the output of surface heat sensors 34*x*, as opposed to the output from interior heat sensors 34, as the signal that logic and control unit 31 uses to make the comparisons with the known signal range and adjust the current flow based upon that comparison. The second, as a checking means, whereby if the signal from sensors 34*x*, transmit a signal that deviates by more than a certain percent from the known signal range, logic and control unit 31 will alert the operator of copier 1 that a fusing problem may exist.

While it has been stated that each individual pattern grouping, of heat elements 36, must be able to produce a specified fusing temperature range, in specified areas, about the periphery of the surface of fusing roller 4, the location of each pattern grouping, of heat elements 36, while being restricted as to its location between the ends of fusing roller 4, said pattern groupings are not restricted to a particular location between the axis of fusing roller 4 and the peripheral surface of fusing roller 4, since adjustments in the amount of electrical current supplied to any pattern grouping, of heat elements 36, will compensate for the distance between that pattern grouping, of heat element 36, and the surface of fusing roller 4. However, to conserve energy, the pattern grouping or pattern groupings, of heat elements 36, used to supply heat for fusing normal 8½ by 11 inch paper are located closest to the surface of fusing roller 4. This limits heat loss caused by heat travel through the interior of fusing roller 4 when 8½ by 11 paper, the most used receiver, is being used and thereby conserves the most energy.

With the ability to constantly monitor and to apply, increase, decrease or cease the flow of concentrated heat from a multitude of pattern groupings or combination of pattern groupings, of heat elements 36, to designated portions about the periphery of fusing roller 4, a predetermined optimum surface fusing temperature for any receiver 22, sensed in tray 24, may be quickly produced and maintained at the surface of fusing roller 4. This monitoring and control of heat flow eliminates the prior art problems caused by the limited ability to adjust and quickly respond to different widths of paper, varying demands of thermal output due to uneven absorption of heat and different machine modes. This monitoring and control of heat flow also conserves electrical energy and extends the life of fusing roller 4, since only electrical energy needed for proper fusing is generated and only the area of fusing roller 4, required to be heated, is heated thereby limiting the effects of fatiguing to fusing roller 4.

Although only one embodiment of the present invention has been described above in detail, it will be appreciated by one of ordinary skill in the art that various departures from the specific embodiment disclosed are possible without departing from the fundamental scope of the invention. Accordingly, the invention is not intended to be and should not be regarded as limited to the specific embodiment described, but is rather limited only according to the following claims.

What is claimed is:

1. A fusing roller for fusing an image onto a receiver comprising:

a cylindrical member of thermally conducting material having a peripheral surface at which the receiver is fused;

at least three pattern groupings of heat elements contained within the cylindrical member for individually generating an even heat flow distribution to specific areas about the peripheral surface of the cylindrical member and at least two pattern groupings of heat elements provide heat flow distribution to the same specific area about the peripheral surface of the cylindrical member individual heat elements of the same pattern grouping are of the same heating capacity, individual heat elements not of the same pattern grouping are of different heating capacity and each pattern grouping having a different heating capacity; and heat sensing means positioned within said cylindrical member adjacent to the heat elements for sensing the heat generated from the heat elements.

2. The fusing roller of claim 1 wherein each pattern grouping is positioned within the cylindrical member for providing an even fusing temperature distribution to specific areas about the peripheral surface of the cylindrical member for fusing the receiver.

3. A fusing roller for fusing an image onto a receiver comprising:

a cylindrical member of thermally conducting material, said member having an inner and outer cylindrical surface, at least three pattern groupings of heat elements positioned between the inner and outer surfaces, the elements of each group being of the same heating capacity and being evenly spaced around the axis of the cylindrical member and located at the same axial position, the elements of different groups providing an axially different heat capacity and at least two pattern groupings of heat elements provide heat flow distribution to the same specific area about the peripheral surface of the cylindrical member, and heat sensing means positioned between the inner and outer surfaces of the cylindrical member adjacent the heat elements for sensing the heat generated from the heat elements.

4. A multi-zoned heat fusing apparatus comprising:

a fusing roller for fusing, at its peripheral surface, an image onto a receiver, said fusing roller having a cylindrical member of thermally conducting material and at least three pattern groupings of heat elements contained within the cylindrical member for individually generating an even heat flow distribution to specified areas about the peripheral surface of the fusing roller and at least two pattern groupings of heat elements provide heat flow distribution to the same specific area about the peripheral surface of the cylindrical member, individual heat elements of the same grouping are of the same heating capacity, individual heat elements not of the same grouping are of different heating capacity and each pattern grouping having a different heating capacity;

heat sensing means positioned within the cylindrical member adjacent the heat elements for sensing the heat generated from the heat elements;

a logic and control unit responsively connected to said heat sensing means for comparing the heat sensed by the heat sensing means with a known value; and means responsively connected to said logic and control unit and also connected to the groupings of heat elements for supplying electric current of specified amounts to specified groupings of heat elements in response to comparisons made by the logic and control unit.

5. The multi-zoned heat fusing apparatus of claim 4 further comprising receiver sensing means connected to the logic and control unit for sensing the size of the receiver to be fused and signaling the logic and control unit in order that the proper initial heat flow to the peripheral surface of the fusing roller may be generated for fusing the receiver.

* * * * *

UNITED STATES PATENT AND TRADEMARK OFFICE

CERTIFICATE OF CORRECTION

PATENT NO. : 5,241,159

DATED : August 31, 1993

INVENTOR(S) : Dilip K. Chatterjee et al

It is certified that error appears in the above-indentified patent and that said Letters Patent is hereby corrected as shown below:

On the title page, item [19] should read --Chatterjee et al.--; Item [75] Inventors: change "chatteriee" to --Chatterjee--; and change "Paz-Puzalt" to --Paz-Pujalt--.

Signed and Sealed this

Twentieth Day of September, 1994

*Attest:*

*Attesting Officer*

Bruce Lehman

BRUCE LEHMAN

*Commissioner of Patents and Trademarks*